United States Patent [19]

Snyder et al.

[11] Patent Number: 4,962,708

[45] Date of Patent: Oct. 16, 1990

[54] ELECTRIC/NON-ELECTRIC INITIATION SYSTEM

[76] Inventors: Richard N. Snyder, 8 Kristen Rd., Garrisonville, Va. 22463; Percy R. Rainwater, 10031 Old Colchester Rd., Lorton, Va. 22079

[21] Appl. No.: 282,757

[22] Filed: Dec. 12, 1988

[51] Int. Cl.[5] ..... F42D 1/045

[52] U.S. Cl. ..... 102/275.11; 102/275.6

[58] Field of Search ..... 102/220, 275.6, 275.11, 102/322

[56] References Cited

U.S. PATENT DOCUMENTS

| | | | |
|---|---|---|---|
| 3,250,034 | 5/1966 | Simmons | 42/84 |
| 3,301,185 | 1/1967 | Foster | 102/322 |
| 3,395,641 | 8/1968 | Frost | 102/301 |
| 3,553,877 | 1/1971 | Welch et al. | 42/70.11 |
| 4,261,127 | 4/1981 | Karkkainen | 42/70.11 |
| 4,381,711 | 5/1983 | Lawrence | 102/275.6 |
| 4,674,047 | 6/1987 | Tyler et al. | 102/200 |
| 4,817,530 | 4/1989 | Florin | 102/322 |
| 4,825,765 | 5/1989 | Ochi et al. | 102/200 |

OTHER PUBLICATIONS

Explosives and Demolitions—Engineer Field Manual; War Dept., FM 5-25; Jan. 1942; pp. 16-20.

*Primary Examiner*—Charles T. Jordan

*Attorney, Agent, or Firm*—Lane, Aitken & McCann

[57] ABSTRACT

This invention relates to safety and simplicity in initiating high explosives. The new method uses a hybrid system for electro-mechanically initiating either fast burning detonating cord or slower burning plastic initiating tube or fires electric blasting caps.

The subject initiating system consists of four (4) basic components: a capacitor discharge power supply connected to a standoff cable reel, a wiring standoff cable spooled out from said reel to a solenoid housing.

Within the housing, the system is again broken down into sub-components. A connector plug and socket connects the standoff cable to a pulse type electrical solenoid. The solenoid is positioned so that when said solenoid is electrically actuated the solenoid's plunger or firing pin strikes a shot shell primer which is inserted into a coupling device. The explosive force of the shot shell primer when fired generates adaquate pyrotechnic energy to start the burning process of the initiating line, which, in turn, initiates a blasting cap, explosive primer or both, resulting in high explosive detonation. In the electric mode this instrument fires electric blasting caps in a conventional manner using the same electronic capacitor discharge power supply.

Low energy level is referencing a shot shell primer (low energy level) to an electric blasting cap (high energy level).

4 Claims, 1 Drawing Sheet

ELECTRIC/NON-ELECTRIC INITIATION SYSTEM

BACKGROUND OF THE INVENTION

Figure 1:
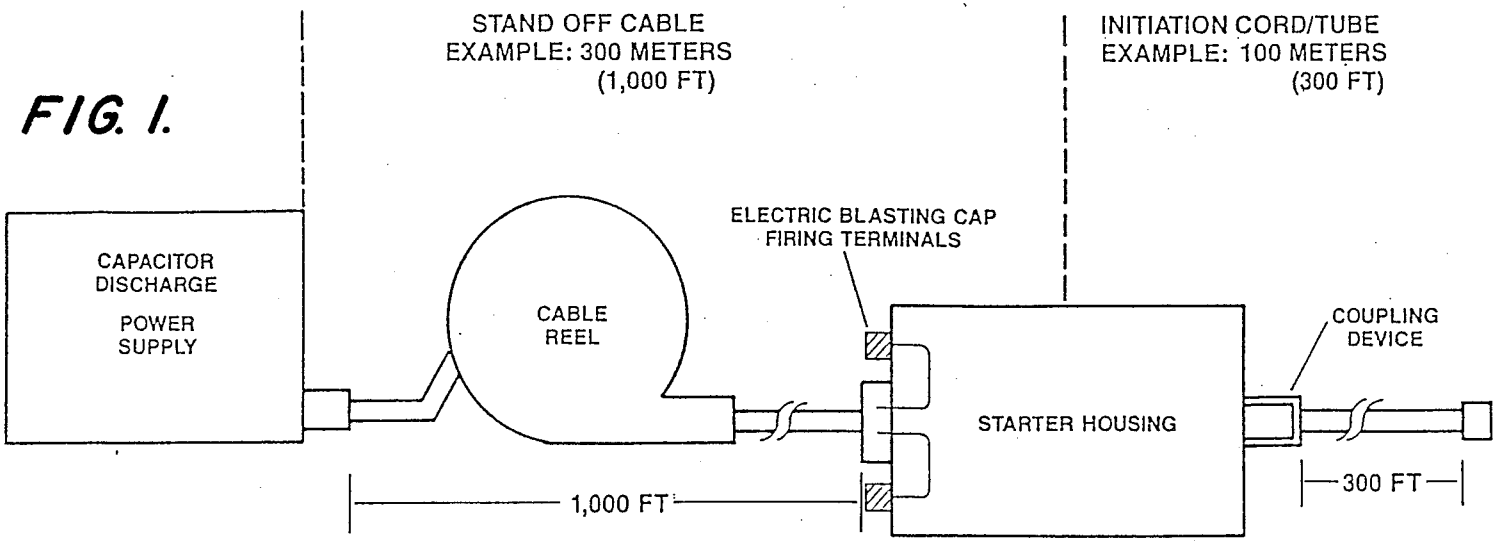

The invention relates to the use of high explosives. To be more specific, this device relates directly to the safe initiation of multiple types of initiating cord presently in use today, carrying out the various blasting needs in mining operations, in building highways, dams, water and sewer systems, as well as in military applications, to name a few.

At the present time, there are three (3) known and widely used systems for initiating high explosives. The high explosives have been designed to be desensitized for obvious reasons, mainly to allow for manufacturing storage, transportation and handling safely without fear of premature detonation.

Two prime considerations when using high explosives are (1) placing the blaster a safe distance from the explosion to prevent injury from flyrock, flames, concussion, or a combination of the three, and (2) initiating the material which provides the safe distance (standoff) between the blaster and the blast. The standoff distance cannot be identified as a specific distance of measure and is therefore directly related to many blasting accidents.

Three primary methods of detonation available to the blaster to provide standoff distance: (1) electric blasting using wire and electric blasting caps (2) radio controlled blasting using communication telemetry and (3) initiation cord or tube. This patent applies to the electric and non electric method.

Using the initiation cord or tube method, sufficient energy must be available to reach the high explosive and to detonate the less sensitive yet largest volume of explosives which perform the work at the blast site.

One method of starting the initiation cord/tube is by an electric blasting cap, with the blaster initiating the cap by wire from a distance using a blasting machine. This technique is dangerous since the blasting cap contains much more high explosives than is necessary to start the initiation cord/tube, and blasting caps must be logistically accounted for under federal law. These caps are prone to radio frequency energy which can cause premature detonation.

Another method of starting initiation is a mechanical starter comprised of a shot shell primer coupled directly to the initiation "tube". This method is also dangerous as close proximity to the detonating cord can cause bodily injury because of its external burning rate of approximately 24,000 feet (7000 meters) per second. Despite this possibility of danger, the shot shell primer, which has far less dangerous effects than the electric blasting cap, has been proven to provide initiation effectively. Another drawback in using this technique, however, is the waste of initiation tube which can only be used one time and is then discarded. This can be expensive, if the minimal standoff distance is 1000 feet (300 meters) then 1000 feet of material must be gathered and discarded.

This invention combines two of the best methods of initiation, i.e., shot shell primer, a low intensity device, and reusable electric wire to provide a standoff distance far greater than nominal and may be used many times over. The capacitor discharge power supply serves both methods and initiates electric blasting caps using the conventional electric blasting techniques, the same standoff cable and the same housing which includes the non electric firing device as a junction box to provide electric blasting connections.

BRIEF SUMMARY OF A PREFERRED EMBODIMENT OF THE INVENTION

One preferred embodiment of the invention which is intended to perform some of the foregoing objectives is a small compact electronic device, transported easily by one person in the field. Use of the device is less costly and contributes significantly to safety factors, such as:

(1) low energy level initiation (2) immune from radio frequency energy and premature discharge (3) a predetermined standoff distance tailored to the blaster's requirements of always being at a safe distance from the blast (4) watertight coupling to prevent misfires caused by water or moisture in the initiation tube (5) coupling retains initiation cord/tube to prevent injury from whiplash when initiated (6) shot shell primers consist of a minute amount of explosive charge and can be handled safely since high impact is necessary for their detonation.

Since both electric and non electric blasting methods prevail, this system provides the blaster with both options, the non electric, however, is truly non electric and is radio frequency and stray current immune.

DRAWING

FIG. 1: OVERALL SYSTEM (1) capacitor discharge power supply (2) stand off cable (3) starter housing

Figure 2:
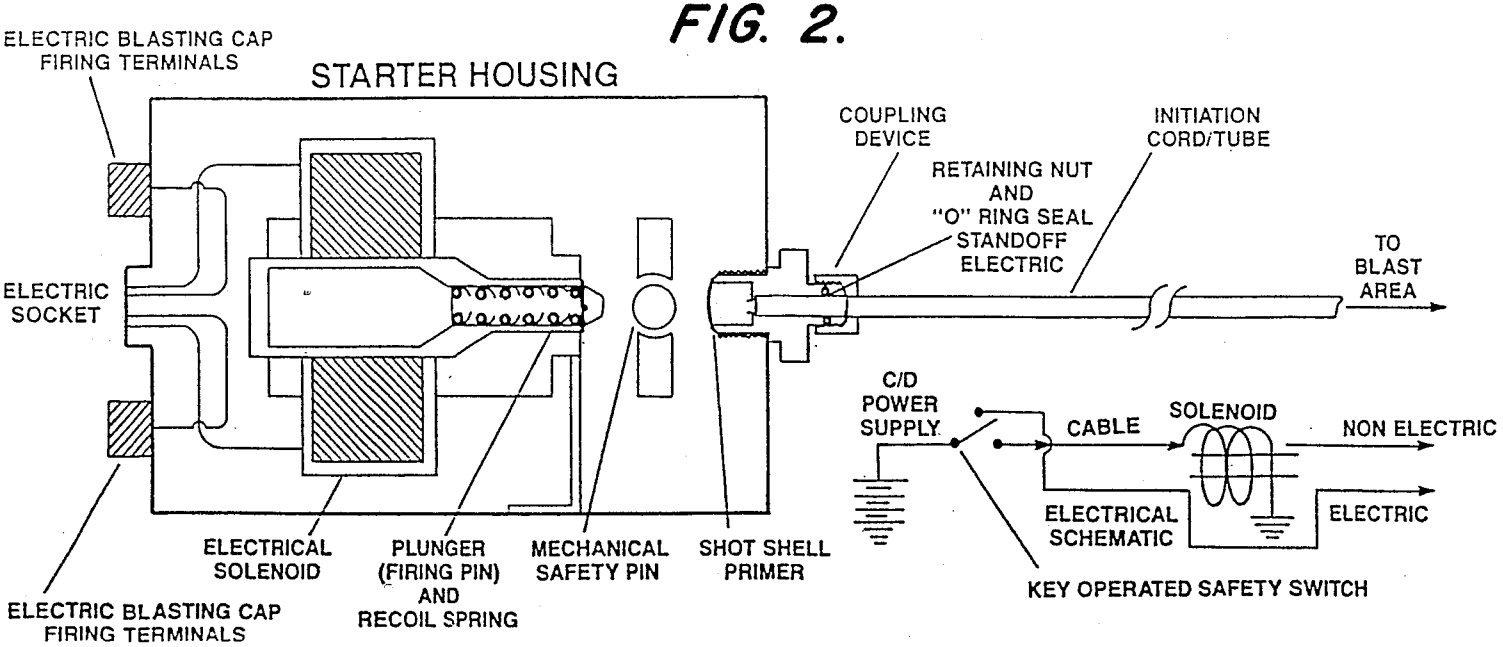

FIG. 2: STARTER HOUSING (1) starter housing (2) electric solenoid (push type pulse operated)

(3) firing pin and recoil spring (4) shot shell primer (5) coupling device (6) retaining nut and "O" ring seal (7) electric blasting cap firing terminals (8) mechanical safety pin.

METHOD OF OPERATING THE LOW LEVEL INITIATION SYSTEM

The task of operating this invention consists of carrying the three (3) components connected together as one to the blast site, the blast having been preloaded.

The non electrictrunk line, having been extended away from the blast site is then connected to the coupling device on the starter, a part of the initiator housing element.

The standoff lead wire is connected to the other end of the starter.

The reel and standoff wire are spooled out away from the blast site to a predetermined safe distance.

The mechanical safety lock is removed.

At this point, the capacitor discharge power supply is connected to the stand off cable. The operator's key is now inserted into the key operated firing switch.

The operator then sounds the danger signal, and initiates the blast by turning the key operated firing switch to the "non electric" firing position, activating the electric solenoid and completing the blast sequence.

Electric blasting is carried out in the same manner prescribed above using conventional electric blasting techniques and the electric firing terminals mounted on the initiator housing.

OPERATION (1) The operator switches the "safety interlock switch" and observes the "armed" continuity light for an indication.

(2) The operator pushes the fire switch, completing the firing sequence.

Having described the invention, reference has been made to a preferred embodiment of the invention, using illustrative advantages of the invention. Those more skilled in the arts, however, and familiar with overall disclosure of the subject invention, may recognize modifications, deletions, or additions and substitutions or changes which will fall within the pervue of the invention and claims.

We claim:

1. A high explosive detonation apparatus comprising initiating cord or tube, a shot shell primer containing an explosive charge, a solenoid actuated firing pin operable to strike said shot shell primer when actuated to ignite said explosive charge, means to couple said initiating cord or tube to said explosive charge to be ignited by the burning of said explosive charge, and actuating means positioned remotely from said solenoid actuated firing pin to actuate said solenoid operated firing pin from a remote position, said solenoid actuated firing pin being actuated by pulsed electrical energy, said actuating means including a key operated firing switch operable to apply said pulsed electrical energy to said solenoid actuated firing pin upon insertion of an operator's key.

2. A high explosive detonation apparatus comprising initiating cord or tube, a shot shell primer containing an explosive charge, a solenoid actuated firing pin operable to strike said shot shell primer when actuated to ignite said explosive charge, means to couple said initiating cord or tube to said explosive charge to be ignited by the burning of said explosive charge, said means to couple said ignition cord or tube comprising a coupling device housing said shot shell primer and providing a water and moisture proof mounting for said initiating cord or tube.

3. A high explosive detonation device comprising initiating cord or tube, a shot shell primer containing an explosive charge, a solenoid actuated firing pin operable to strike said shot shell primer when actuated to ignite said explosive charge, and means to couple said initiating cord or tube to said explosive charge to be ignited by the burning of said explosive charge, and a removable mechanical safety pin positioned between said firing pin and said shot shell primer.

4. A high explosive system comprising initiating cord or tube, a shot shell primer containing an explosive charge, a solenoid actuated firing pin operable to strike said shot shell primer when actuated to ignite said explosive charge, means to couple said initiating cord or tube to said explosive charge to be ignited by the burning of said explosive charge, actuating means positioned remotely from said solenoid actuated firing pin to actuate said solenoid operating firing pin from a remote position, a housing containing said solenoid actuated firing pin, said shot shell primer and said means to couple initiating cord or tube to the explosive charge contained in said shot shell primer, and wherein a pair of electric blasting cap firing terminals are mounted on said housing, and means to energize said terminals from said actuating means.

* * * * *